US008393304B2

(12) United States Patent
Lankinen

(10) Patent No.: US 8,393,304 B2
(45) Date of Patent: Mar. 12, 2013

(54) METHOD OF AND APPARATUS FOR SUPPORTING WALLS OF A POWER BOILER

(75) Inventor: Pentti Lankinen, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 1131 days.

(21) Appl. No.: 12/097,383

(22) PCT Filed: Dec. 14, 2006

(86) PCT No.: PCT/FI2006/050555

§ 371 (c)(1),
(2), (4) Date: Oct. 29, 2008

(87) PCT Pub. No.: WO2007/068802

PCT Pub. Date: Jun. 21, 2007

(65) Prior Publication Data

US 2010/0294215 A1 Nov. 25, 2010

(30) Foreign Application Priority Data

Dec. 15, 2005 (FI) ..... 20055674

(51) Int. Cl.
*F22B 37/24* (2006.01)

(52) U.S. Cl. ..... 122/511; 122/493; 122/496

(58) Field of Classification Search ..... 122/510, 122/450, 511, 493, 496, 495, 512
See application file for complete search history.

(56) References Cited

U.S. PATENT DOCUMENTS

| | | | | |
|---|---|---|---|---|
| 3,203,376 | A * | 8/1965 | Engelhardt | 110/317 |
| 3,368,535 | A | 2/1968 | Svendsen et al. | 122/510 |
| 3,379,177 | A * | 4/1968 | Stalph | 122/6 A |
| 3,814,063 | A * | 6/1974 | Bijmholt | 122/6 A |
| 5,299,535 | A | 4/1994 | Payne | 122/510 |
| 5,317,993 | A * | 6/1994 | Payne | 122/510 |
| 5,329,892 | A | 7/1994 | Svendsen | 122/510 |
| 5,762,032 | A | 6/1998 | Patel | 122/493 |

FOREIGN PATENT DOCUMENTS

| | | | |
|---|---|---|---|
| AT | 378 250 | | 11/1984 |
| EP | 0 591 183 | | 4/1994 |
| EP | 0 777 080 | B1 | 1/2000 |
| FR | 1072831 | | 9/1954 |
| JP | 52-113401 | | 9/1977 |
| JP | 6-193809 | | 7/1994 |
| JP | 8-296807 | | 11/1996 |
| JP | 9-178109 | | 7/1997 |
| JP | 09178109 | * | 7/1997 |

(Continued)

OTHER PUBLICATIONS

International Search Report dated Dec. 6, 2007, which issued in corresponding International Application No. PCT/FI2006/050555.

(Continued)

*Primary Examiner* — Gregory A Wilson
(74) *Attorney, Agent, or Firm* — Fitzpatrick, Cella, Harper & Scinto

(57) ABSTRACT

A method of supporting walls of a hanging furnace of a thermal power boiler, in which method, the walls, being formed of vertical water tubes, are supported horizontally at least by means of buckstays, and vertical pillars, located outside the buckstays, are attached to the ground or the foundations of a boiler building. The method includes attaching beams to the outer surface of the water tube walls, parallel with the vertical water tubes of the walls. Buckstays are attached to the outer surface of the beams. The buckstays are positioned substantially perpendicular to the vertical water tubes of the walls. At least two of the walls, located on opposite sides of the furnace, are connected to the vertical pillars by means of the beams and by an attachment connected directly to the beams and to the pillars, in such a way that pressure loads directed perpendicularly to the water tube walls are transferred by means of the vertical pillars to at least one rigid plane surrounding the boiler.

13 Claims, 3 Drawing Sheets

FOREIGN PATENT DOCUMENTS

| | | | |
|---|---|---|---|
| JP | 11-241805 | | 9/1999 |
| JP | 2000-2401 | | 1/2000 |
| JP | 2001-304505 | | 10/2001 |
| JP | 2002-168403 | | 6/2002 |
| JP | 2002-257303 | | 9/2002 |
| RU | 2 037 091 | C1 | 6/1995 |
| RU | 2 047 044 | C1 | 10/1995 |
| RU | 2 156 918 | C2 | 9/2000 |

OTHER PUBLICATIONS

Written Opinion mailed Dec. 14, 2007, which issued in corresponding International Application No. PCT/FI2006/050555.

Finnish Office Action dated Aug. 22, 2006, issued in related Finnish patent application No. 20055674.

International Preliminary Report on Patentability Jun. 4, 2008, which issued in corresponding International Application No. PCT/FI2006/050555.

Russian Decision of Granting a Patent for Invention dated Aug. 6, 2009, issued in counterpart Russian patent application No. 2008128878/06(035615), with an English translation.

Chinese Second Office Action dated May 23, 2011, issued in counterpart Chinese patent application No. 200680046983.6, with an English translation.

* cited by examiner

METHOD OF AND APPARATUS FOR SUPPORTING WALLS OF A POWER BOILER

This application is a U.S. national stage application of PCT International Application No. PCT/FI2006/050555, filed Dec. 14, 2006, and published as PCT Publication No. WO 2007/068802 A2, and which claims priority from Finnish patent application number 20055674, filed Dec. 15, 2005.

FIELD OF THE INVENTION

The present invention relates to a method of and an apparatus for supporting walls of a power boiler. In more detail, the present invention relates to a thermal power boiler, which generally comprises the actual furnace and means for treating flue gases and, in the case of a circulating fluidized bed boiler, also comprises means for circulating bed material and recirculating the material to the furnace. The invention especially relates to supporting panel-structured walls of such a boiler.

BACKGROUND OF THE INVENTION

Conventionally, the power boilers of the invention are provided with so-called water tube walls, which consist of adjacent water tubes with plate-like fins therebetween. The purpose of the water circulating in the water tubes is to recover heat generated in the combustion. However, such a water tube wall is, considering its size, relatively light in structure and does not endure additional stresses as such without bending. These stresses can result, for example, from variations in the flue gas pressures, and, thus, the wall must be supported to maintain the desired shape. Furthermore, it is known that when the water tube wall is provided with additional equipment, the thermal expansion in the walls and in the whole boiler must be taken into consideration.

The panel-structured walls of the previously described type are conventionally stiffened by utilizing horizontally extending buckstay systems, or frames comprising beams connected to one another through corner link assemblies, in a manner allowing relatively free differential thermal expansion between the hot furnace walls and the cooler beams. The number of the beam frames is determined by the stiffness of the furnace walls, which, again, is affected by the size and distribution of the tubes in the water tube wall. The beams forming the frame are dimensioned as simply-supported beams, whereby their size is determined based on the width of the wall and the vertical distribution of the beams.

Supporting arrangements of power boiler walls according to the prior art are disclosed, for example, in patent specifications and published applications U.S. Pat. No. 3,379,177, U.S. Pat. No. 3,814,063, U.S. Pat. No. 3,368,535, European Patent No. B1-0 591 183, Japanese Laid-Open Patent Application No. A2-2001-304505, No. A2-2002-257303, No. A2-2000-2401, No. A2-06-193809, No. A2-52-113401, No. A2-8-296807, and No. A2-11-241805.

U.S. Pat. No. 3,379,177 discloses a power boiler and the supporting structure of its walls. The publication discloses one known manner of constructing a power boiler. A substantial part thereof is that the whole boiler structure is suspended to hang on steel structures, more specifically, to hang on a supporting plane belonging to the steel structures and being located above the boiler in such a way that the supporting structures of the boiler walls are also suspended to hang on the supporting plane. The supporting structures of the walls comprise vertically spaced buckstays located perpendicular to the water tubes against each outer wall of the boiler. The attachment of the buckstays allows some movement between the wall and the buckstay to allow for the thermal expansion/contraction of the wall in the direction of the buckstay. The buckstays, on the other hang, are slidingly supported against vertical I-beams of their side opposite to the wall of the boiler. There are several I-beams across the width of each wall and they are suspended, as already mentioned above, to hang on the steel structures of the boiler building, i.e., to hang on the above-mentioned supporting plane. These vertical I-beams, in turn, are supported by a horizontally positioned beam frame welded to the I-beams of the side opposite to the buckstays and comprise rigid beam trusses located on each side of the boiler. These beam trusses form the beam frame surrounding the boiler by means of flexible corner link assemblies, which, for their part, allow for the changes in the outer dimensions of the boiler, which result from the changes in the temperature.

U.S. Pat. No. 3,814,063 also discloses a top-supported power boiler and, more accurately, an alternative way of carrying out a support structure of a water tube wall. In this arrangement, the water tube wall is connected to I-beams, which are attached, in the same way as the boiler, from their top, to hang on a supporting plane, but spaced apart from the boiler, by means of rods joined at both ends, so that one end of the rod can side with respect to the vertical beam. The joined rod is connected to the water tube wall by means of a substantially square leg portion extending across a number of water tubes. The vertical I-beams, again, are attached to a horizontally positioned truss structure, surrounding the whole boiler, form the sides opposite to the joined rods.

Japanese Laid-Open Patent Application No. A2-2001-304505 also discloses a top-supported power boiler hanging from a support plane of the upper part and an apparatus, by means of which vibration and swinging motions of the power boiler are prevented, for example, during an earthquake. At the same time, a support arrangement for the walls of a power boiler is disclosed. In the discussion of prior art in the publication, there is disclosed a method of attaching the buckstays substantially horizontally to a wall of the power boiler, in such a way that the attachment thereof allows for differential thermal expansion of the wall and the buckstay. The buckstay is actually attached to the wall by means of a specific mounting eye in such a way that the mounting eye is attached to the boiler wall. The buckstay is attached to the mounting eye by a bolt, for which, however, there is arranged an oblong hole to the buckstay, which allows for the differential thermal expansion of the boiler wall and the buckstay by allowing sliding in the longitudinal direction of the attachment bolt in the hole. The buckstays have been attached to vertical rods from the sides opposite to the boiler in the groups of a few buckstays, in such a way that one buckstay from each group is stationarily attached to the rod, while the other buckstays are allowed to slide in the longitudinal direction of the rod in a manner required by the thermal expansion of the boiler wall. The rods, in turn, are attached to steel structures of the power boiler supported to the ground in a manner allowing vertical sliding. In other words, they are attached in such a way that the thermal expansion of the boiler walls does not direct any vertical forces to the steel structures. In other words, both the buckstays and the vertical rods attached thereto are suspended by means of the boiler to hang on the supporting plane of the upper part of the steel structures of the power plant.

Among other things, it is a typical feature of all arrangements disclosed in more detail above, as well as of all other arrangements mentioned in the above-mentioned publications, that the supporting structures of the boiler walls are suspended to hang on the supporting plane of the upper part of the steel structures of the boiler building, either together with the boiler or by means of special separate suspending means.

Such a suspending of support structures, however, brings about some disadvantages. Whether the suspending has been done by either of the above-described manners, the weight of the supporting structures, which consist, depending on the method of suspension, at least of the buckstays, the vertical beams connected to the buckstays and the possible truss structures connected to the vertical beams, forms a considerable part of the total load to the steel structures. Furthermore, when the size of the boilers increases, it is evident that the weight of the supporting structures increases at least in the same ratio. Thereby, naturally, the steel structures used for suspension of the supporting arrangements of the boiler and the walls thereof must be increased in the same ratio with the increasing loadings.

It is, however, possible to minimize the problems by changing the support of the water tube walls, such that the majority of the support comes directly from the foundations, or the like, without any top-supported suspensions of the prior art. Furthermore, the weight of the supporting structures loading the upper supporting level of the boiler can be reduced by modifying the supporting structures of the boiler walls in such a way that the system works by lighter buckstays or even by arranging as large a portion of the supporting structures as possible to be ground-supported or supported to the foundation of the boiler building without a need to suspend the supporting structures to hang on the supporting plane of the upper part of the boiler.

Another problem encountered is that the buckstays are subjected to considerable stresses, regardless of the manner in accordance with the prior art, by means of which, they are arranged into connection with the boiler walls. This is because the buckstays are used not only for their actual purpose. In other words, the buckstays not only may be used for supporting the boiler walls against normal loads, but also, for transferring the loads against the boiler walls forward. In such structures, the buckstays are subjected at a time to at least one of compression, bending and torsion.

The above-mentioned drawbacks are solved, in accordance with the present invention, by means of a method of supporting walls of a thermal power boiler. In this method, the furnace of the thermal power boiler is suspended to hang on a supporting plane of the upper portion of steel structures especially arranged for the purpose and the walls, being formed of water tubes, are supported horizontally, at least by means of buckstays positioned substantially perpendicular to the water tubes, and vertical pillars located outside the buckstays, which pillars are attached to the ground or the foundations of the boiler building. A characteristic feature of the method in accordance with the invention is that at least two of the walls, located on the opposite sides of the boiler, are supported in such a way that loads directed perpendicularly to the walls are transferred, by means of the vertical pillars, to internal stresses of at least one rigid plane surrounding the boiler.

Correspondingly, for an apparatus in accordance with the invention for supporting walls of a thermal power boiler, the boiler comprises a furnace having walls formed of vertical water tubes and being suspended to hang on a supporting plane of the upper portion of steel structures especially arranged for the purpose, buckstays arranged outside the walls and substantially perpendicular to the water tubes for supporting the walls and pillars arranged on the sides of the boiler outside the buckstays and being attached to the ground or the foundations of the boiler building. It is a characterizing feature that at least one rigid plane surrounding the boiler is attached to the pillars and at least two of the walls, located on the opposite sides of the boiler, are supported to the pillars.

Other characteristic features of the method of and apparatus for supporting walls of the power boilers become apparent in the accompanying claims.

SUMMARY OF THE INVENTION

An advantage of the attachment in accordance with the invention is, naturally, among other things, the fact that the number of the steel structures required in the boiler building substantially decreases. Thus, it will be more inexpensive to construct a complete boiler plant than one in the prior art, both in view of the lesser amount of construction material and the required working hours. To clarify the matter, it can be exemplified by saying that by applying the method and apparatus in accordance with the invention, it is possible, naturally, depending on the size of the boiler, to save in the weight of the required steel structures from some tens, to even some hundreds, of tons.

Another advantage of the invention is that the structure in accordance with an advantageous embodiment of the present invention enables the lightening of the buckstays, because the structure does not cause compression or twisting of the buckstay, and, thus, it is not necessary to dimension the buckstays to bear the corresponding loads.

A third advantage of the invention worth mentioning is that, in an arrangement in accordance with another preferred embodiment of the invention, it is possible to lighten the buckstays further, in such a way that the space between the boiler and the separator can be constructed to be smaller than before, without losing any of the support of the walls.

BRIEF DESCRIPTION OF THE DRAWINGS

The method and apparatus of the present invention for supporting walls of the power boiler are discussed in more detail below with reference to the attached drawings, in which FIG. 1 schematically illustrates a cross section of the center portion of the furnace of a power boiler, in which the arrangement in accordance with the present invention has been applied.

DETAILED DESCRIPTION OF THE PREFERRED EMBODIMENTS

Figure 1:
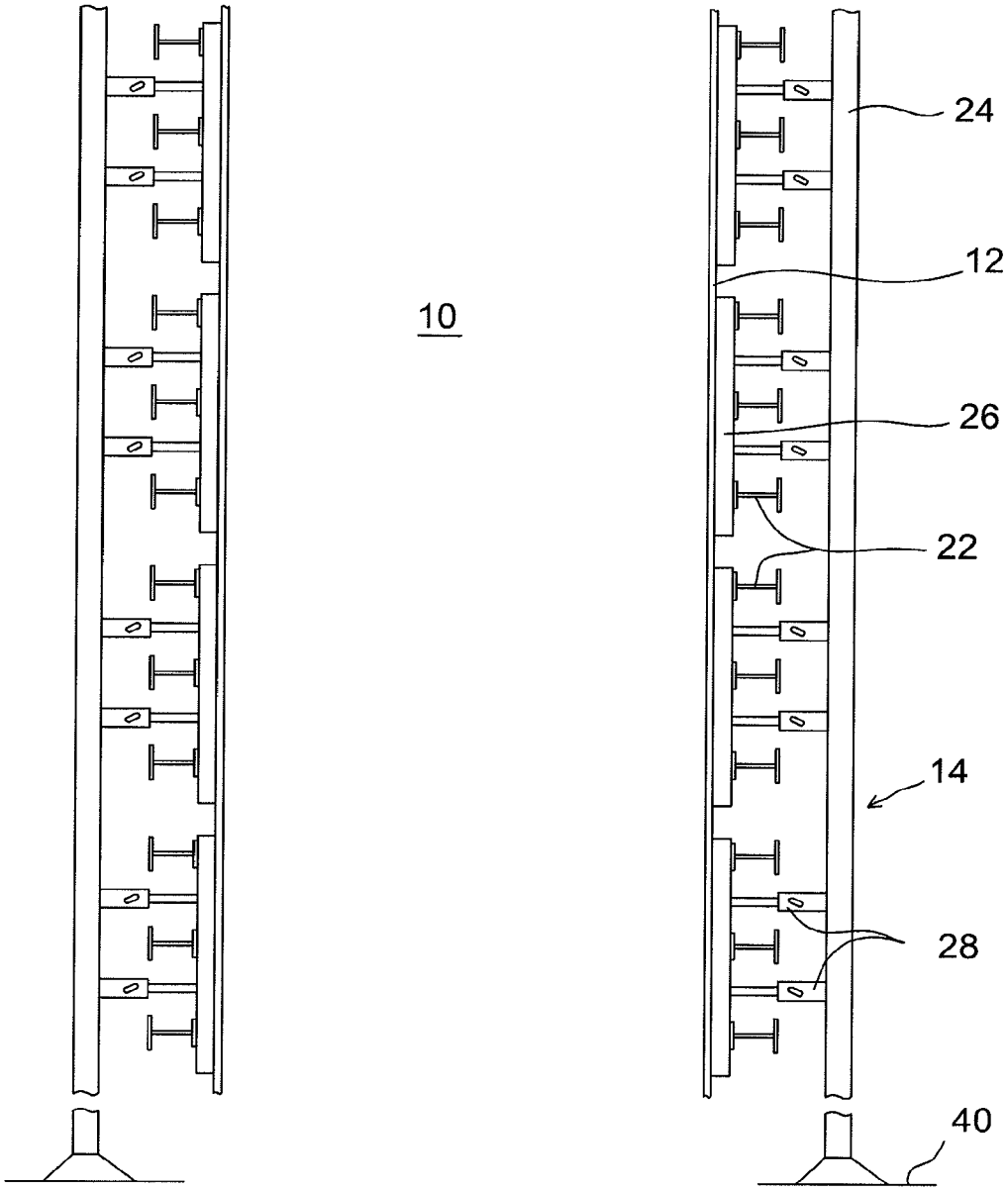

FIG. 1 schematically illustrates a sectional view of a power boiler, cut of its lower and upper part in such a way that only the central parts of the opposing vertical walls of the boiler are shown. Thus, the drawing shows neither the suspending means of the boiler, nor the channels for the inflowing or outflowing materials. The drawing, thus, shows merely a part of the furnace 10 of the power boiler surrounded by the boiler walls 12, which, in most of the cases, form a rectangle, and means 14 related to the actual supporting of the wall 12. The boiler walls 12 are formed, in the manner known also from the prior art boilers, of water tube panels, in which the vertical water tubes are connected to each other by means of fins parallel to the wall plane. As mentioned above, in connection with the discussion of the prior art, such a water tube wall is supported at the side opposite to the furnace 10 by means of substantially horizontal buckstays, marked with the reference numbers 22 in the figure, by means of which bulging of the walls 12 outwards, for example, due to the pressure change in the flue gases, is prevented.

Figure 2:
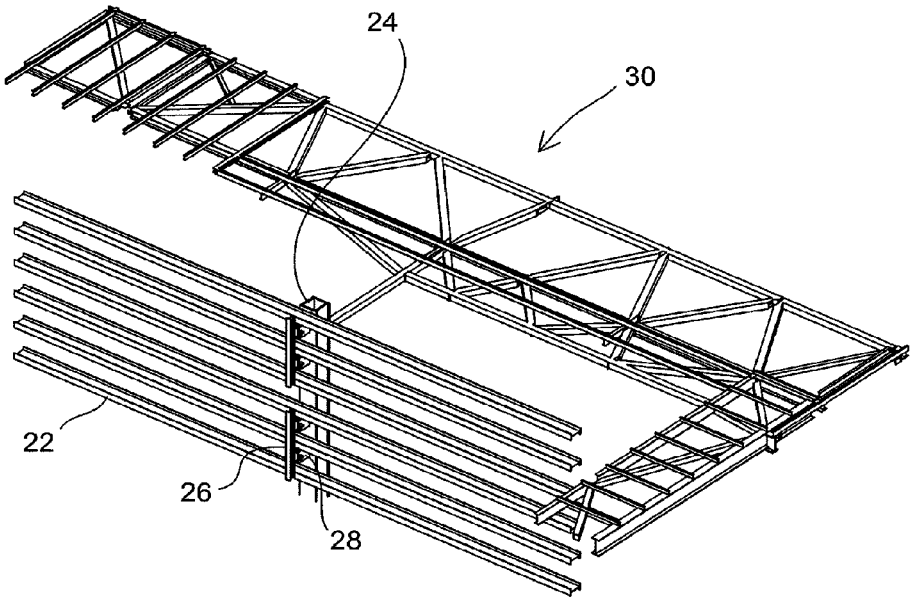
FIG. 2 illustrates an arrangement in accordance with a preferred embodiment of the invention in more detail.

Both FIG. 1, and, in more detail, FIG. 2, now illustrate a method in accordance with a preferred embodiment of the invention of supporting the buckstays 22 arranged perpendicular to the direction of the water tubes to the walls 12, and of supporting the walls 12, in turn, to pillars 24 extending from the ground, or more generally, from the basis, i.e., in most of the cases, from the foundations 40 of the boiler building substantially throughout the height of the boiler. The pillars 24 are located at least one pillar on each side of the boiler. FIGS. 1 and 2 illustrate how, in this preferred embodiment of the invention, vertical beams 26, or rather, beams parallel to the water tubes, have been attached to the boiler walls 12. Preferably, the attachment of the beams is performed from one point in such a way that differential thermal expansion of the wall and the beam does not create any additional stresses, either to the attachment or to the wall or to the beam. The beams 26 are either continuous for a substantial part of the height of the boiler wall (when the water tubes are vertical) or the beams can be formed of parts, which, however, form on each boiler wall, according to this embodiment, a substantially vertical beam line. Furthermore, there may be one or more such substantially continuous beams 26 or beam lines formed of a number of shorter beams on each boiler wall 12. The above-mentioned buckstays 22 have been attached to the side of the beams 26 opposite to the boiler wall 12. When there is only one beam/beam line 26, but, especially, when there are more beams 26, it is substantial that the attachment between the beams 26 and buckstays 22 is flexible for at least all but one beam. Such a flexible attachment may be arranged, for example, in a manner disclosed in the prior art, e.g., Japanese Laid-Open Patent Application No. 2001-304505. Correspondingly, it is possible to connect the buckstays 22 at their ends to each other in the corner of the walls 12, for example, in a manner disclosed in Japanese Laid-Open Patent Application No. 2000-2401.

FIGS. 1 and 2 also illustrate how the beams 26 with the buckstays 22, or parts thereof with the buckstays 22, are supported to the vertical pillar 24. This is carried out by the use of mounting means 28. The mounting means 28 allows for certain limited motion of the beams 26 outwards. In other words, the displacement of the beams 26, both in the longitudinal direction and transverse direction, due to thermal motions of the boiler, is allowed. Naturally, if there are beams 26 attached to other parts of the wall, except for the center line of the wall, also, the sideways motion of the beams 26 caused by the temperature change of the boiler walls, must be allowed.

FIG. 2 discloses a sectional perspective view of a part of the support of the walls 12 of the power boiler, from the inside, in such a way that the actual water tube wall of the actual boiler is cut away. The figure illustrates a support arrangement, in which there is only one beam line on one wall of the boiler, where the beam is divided in the longitudinal direction into parts 26. It must be noted at this point that there may be, as mentioned above, more beams or beam lines on the boiler wall, depending mainly on the width of the wall to be supported, but also, on the dimensions of the rest of the boiler. Thus, when the dimensioning of the support of the boiler wall is based on a certain maximal bending of the buckstays, it is possible to lighten the buckstays by increasing the number of vertical pillars 24 and vertical beam lines 26.

Three horizontal buckstays 22 have been attached in this exemplary embodiment to each part of the vertical beam 26. Naturally, the number of the buckstays 22 to be attached to a vertical beam 26 mostly depends on the required level of the supporting wall and the length of the vertical beam 26. The drawing also shows the attachment 28 of the vertical beams 26 to the pillar 24, which attachment 28 allows for the variations in the dimensions caused by the thermal expansion.

Furthermore, FIG. 2 discloses the support of the vertical pillars 24 in accordance with a preferred embodiment of the invention of the side opposite to the boiler to at least one, preferably, to a number of rigid planes 30 located at different heights. Each of the rigid planes 30 preferably forms a truss-like structure surrounding the whole boiler. It is used for binding at least two opposing sides of the boiler together in such a way that the forces directed normally to the walls from the furnace 10 to the support of the walls 12, compensate for each other due to their opposite directions. Thus, the construction changes the forces into an inner load of the rigid plane 30. In other words, the above-mentioned structural arrangement results, when the stiffened plane is, practically speaking, absolutely stiff, in that the vertical pillars 24 on each side of the boiler cannot move or bend due to the forces coming from the boiler direction, but the forces are transferred by means of the attachment 28 between the vertical pillars 24 and vertical beams 26 to the rigid plane 30.

The vertical distance between the rigid planes 30 is defined, on one hand, by the dimensions of the vertical pillars 24, or the like, and, on the other hand, on the dimensions of the planes themselves. Naturally, it is clear that the lighter the pillar and/or plane is, the more densely located the rigid planes must be to maintain the bucking load within acceptable limits. The location of the rigid planes relative to the boiler is mostly determined by whether it is necessary to leave some space close to the wall, for example, for some service or maintenance means, or if the plane, in turn, can be placed to the close proximity of the wall, whereby it is possible to use the plane at the same time as a walking or service plane. In other words, the planes can be arranged not only directly to the vertical pillars, but, when necessary, they can also be arranged within a desired distance from the boiler by a beam or grid structure appropriate for the purpose, as is disclosed, in fact, in FIG. 2.

Figure 3:
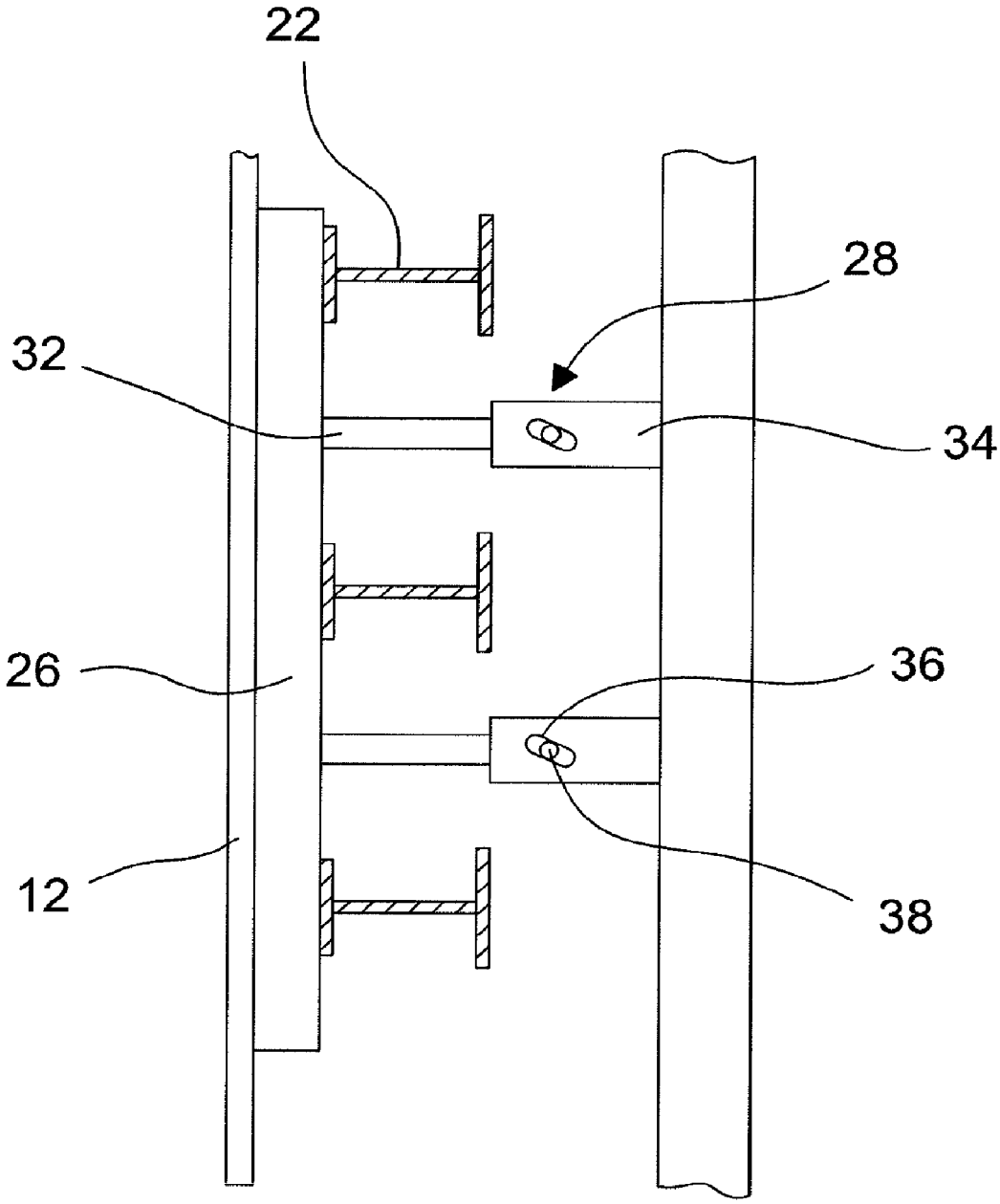
FIG. 3 illustrates, in more detail, the structure of the embodiment shown in FIG. 2.

FIG. 3 illustrates in slightly more detail a preferred embodiment of the attachment 28 of the vertical beams 26 and pillars 24. The attachment 28 in accordance with FIG. 3 comprises a plate 32, or the like, attached either directly or by means of a special rod to a vertical beam 26 and two plates 34, or the like, attached to a pillar 24, also directly or by means of a special rod, located on both sides of the plate 32. Oblong slots 36 are arranged to the plates 34, and in a pin 38, to be placed to the slot 36, is attached to the plate 32 or otherwise arranged thereto. Preferably, the direction of the slots 36 at the top portion of the boiler, relatively close to the suspending point of the boiler, are almost horizontal, because the thermal expansion of the boiler appears there almost only as the increase of the diameter of the furnace. At the lower end of the boiler, a considerable portion of the thermal expansion appears as the increase of the length of the boiler, so the direction of the slot is both downwards and outwards of the boiler. In other words, the thermal expansion of the boiler is compensated for by the direction of the slots 36 in such a way that no stresses resulting from the thermal expansion are directed to the supporting of the boiler walls. In other words, the direction of the slots 36 is used for compensating for the thermal expansion of the boiler in such a way that the wall support of the boiler is not subjected to substantially any stresses resulting from the thermal expansion. Naturally, the orientation of the slots 36 also includes that if the supporting is arranged either merely or also to the side of the vertical center line of the side walls of the boiler, the compensation of the thermal expansion results in that the slots 36 must be directed not only down and out, but also, to a certain extent, sideways. When the boiler walls 12 tend to bulge out in the direction of the normal of the wall, for example, due to the overpressure generated inside the boiler, the vertical beam 26 pushes the pin 38 by means of a plate 32 in the figure to the right against a side wall of the slots 36 of the plates 34. Thereby, for example, the pressure load of the flue gases transfers by means of the pin 38 from the wall 12 to the pillar 24, and further therefrom, to the rigid plane 30. Correspondingly, if an underpressure is generated inside the boiler, the supporting of the wall takes the induced load by means of the other side wall of the slots 36.

The plates 32 and 34, illustrated above, and the rods, or the like, possibly used therewith, support the vertical beam 26 in the disclosed embodiment of two points to the vertical pillar 24. This construction provides a number of advantages. For example, when the buckstays 22 are not attached directly to the pillars 24 by means of an attaching method that allows for the thermal expansion, the buckstays 22 are not subjected to stresses in other than the most advantageous direction, i.e., in the embodiment illustrated in the drawing, in the horizontal direction. Thus, it is only necessary to dimension the buckstays 22 relative to the bending, which results in that beams, constructed to be as light as possible, are sufficient.

According to another preferred embodiment of the invention, the attachment disclosed above in FIG. 3 can be carried out, not only as a support using a pin and a slot, but also, by means of two inclined planes or like surfaces, whereby the inclination angle of the planes corresponds in the manner described above to the inclination angle of the slots 36. Moreover, one of the above-mentioned planes can be replaced by at least one roll at the end of an arm, which roll rolls along the inclined plane. Of course, the arrangement utilizing a roll may be applied with a slot, too, whereby the pin to be located in the slot is the shaft of the roll, and the roll rolls along the surface of the slot. If it is desired to prevent the boiler walls from collapsing inwards, it is possible to arrange, in one of the planes, in the plane arrangement disclosed above, a longitudinal slot extending throughout the plane, to which a bolt, or the like, extending from the opposing plane is located in such a way that the bolt prevents the possible inward motion of the boiler wall. Furthermore, it is possible to diminish the friction between the planes by covering the plates with TEFLON® or a like material appropriate for the purpose.

It must be noted that the above disclosure has been a general description about vertical pillars supported to the ground or the foundations of the boiler building without any detailed analysis about the pillar types. First of all, the pillars can be, for example, continuous I-beams, box beams or truss-constructed beams. Secondly, the pillars can be used to suspend the boiler itself, the building or auxiliary equipment thereof, but they may also be designed and built merely for the structures used for supporting the boiler walls, too.

As has become apparent from the discussion above, a support arrangement is provided which is clearly lighter and, thus, less expensive, than the supporting structures of the walls of the power boiler of the prior art. It must also be noted that although the above discussion relates to boiler walls, it does not literally mean merely furnace walls, but more broadly, all the walls that need supporting, for example, in the furnace or the space connected therewith, due to a pressure change for some reason. Thus, also the walls of the solids separator will come into question in some particular boiler arrangements. It must, however, be noted that the above description discloses only some preferred embodiments of the supporting arrangement and supporting method in accordance with the present invention, which are by no means given to limit the scope of the invention from what is recited in the accompanying claims.

The invention claimed is:

1. A method of supporting walls of a hanging furnace of a thermal power boiler, in which method, the walls, being formed of vertical water tubes, are supported horizontally at least by means of buckstays, and vertical pillars, located outside the buckstays, are attached to the ground or the foundations of a boiler building, the method comprising:

attaching beams to the outer surface of the water tube walls, parallel with the vertical water tubes of the walls;

attaching the buckstays to the outer surface of the beams, the buckstays being positioned substantially perpendicular to the vertical water tubes of the walls; and connecting at least two of the walls, located on opposite sides of the furnace, to the vertical pillars by means of the beams and by an attachment connected directly to the beams and to the pillars, in such a way that pressure loads directed perpendicularly to the water tube walls are transferred by means of the vertical pillars to at least one rigid plane surrounding the boiler.

2. A method in accordance with claim 1, wherein the connecting is performed such that motion of the water tube walls is possible only in the directions caused by motions due to temperature changes of the boiler.

3. A method in accordance with claim 1, wherein the at least one rigid plane surrounding the boiler is attached to the pillars.

4. A method in accordance with claim 1, wherein the beams attached to the outer surface of the water tube walls are vertical.

5. A method in accordance with claim 4, in which the vertical beams are attached directly to the outer surface of the water tube walls.

6. An apparatus for supporting walls of a hanging furnace of a thermal power boiler, the walls being formed of vertical water tubes, and the apparatus comprising:

beams attached to the outer surface of the water tube walls, parallel with the vertical water tubes of the walls;

buckstays, attached to the outer surface of the beams, for supporting the walls, the buckstays being positioned substantially perpendicular to the vertical water tubes of the walls;

vertical pillars arranged outside of the buckstays, on the sides of the boiler, and being attached to the ground or the foundations of a boiler building; and at least one rigid plane surrounding the boiler and attached to the pillars, wherein at least two of the walls, located on opposite sides of the furnace, are connected to the vertical pillars by means of the beams and by an attachment connected directly to the beams and to the pillars, in such a way that pressure loads directed perpendicularly to the water tube walls are transferred by means of the vertical pillars to the at least one rigid plane surrounding the boiler.

7. An apparatus in accordance with claim 6, wherein the beams are connected to the pillars by the attachment, which allows relative motion between the beams and the pillars due to a change in temperature of the boiler.

8. An apparatus in accordance with claim 7, wherein the attachment, which allows relative motion between the vertical beams and the pillars, is formed of a pin-slot pair, whereby the motion direction of the pin in the slot corresponds to the direction of the thermal motion of the boiler.

9. An apparatus in accordance with claim 7, wherein the attachment, which allows relative motion between the vertical beams and the pillars, is formed by a roll or rolls and an inclined plane, in which the direction of the inclined plane corresponds to the direction of thermal motion of the boiler.

10. An apparatus in accordance with claim 6, wherein the buckstays are attached to the water tube walls in groups of several buckstays by means of the beams.

11. An apparatus in accordance with claim 6, wherein the at least one rigid plane is formed of a truss structure surrounding the boiler.

12. An apparatus in accordance with claim 6, wherein the beams attached to the outer surface of the water tube walls are vertical.

13. An apparatus in accordance with claim 12, in which the vertical beams are attached directly to the outer surface of the water tube walls.

* * * * *